United States Patent [19]

Ingram

[11] 4,366,914

[45] Jan. 4, 1983

[54] DRINKING CONTAINER DEVICE WITH ADJUSTABLE CLOSURE

[76] Inventor: Eleanor P. Ingram, 120 Washington St., Helena, Mont. 59601

[21] Appl. No.: 172,387

[22] Filed: Jul. 25, 1980

[51] Int. Cl.[3] ..... A47G 19/22

[52] U.S. Cl. ..... 220/287; 220/90.4; 229/43

[58] Field of Search ..... 220/90.2, 90.4, 90.6, 220/287; 229/43

[56] References Cited

U.S. PATENT DOCUMENTS

| | | | |
|---|---|---|---|
| 1,524,185 | 1/1925 | Lockwood | 220/287 X |
| 2,557,112 | 6/1951 | Kaffer | 229/43 |
| 2,600,479 | 6/1952 | Campomar | 220/90.4 |
| 2,744,631 | 5/1956 | Toombs | 220/90.4 X |
| 3,549,044 | 12/1970 | Lerner | 220/90.4 |
| 3,940,012 | 2/1976 | Addington | 220/90.4 |
| 4,210,272 | 1/1980 | Sequin | 220/90.4 X |

FOREIGN PATENT DOCUMENTS

| | | | |
|---|---|---|---|
| 3462 | of 1895 | United Kingdom | 220/90.4 |
| 1229426 | 4/1971 | United Kingdom | 220/90.4 |

*Primary Examiner*—William Price
*Assistant Examiner*—Gary E. Elkins
*Attorney, Agent, or Firm*—Arthur L. Urban

[57] ABSTRACT

A device for a drinking container including a positioning portion and a contents-restraining portion, the positioning portion including a periphery-engaging section, the periphery-engaging section including resilient sidewall contacting members, the contents-restraining portion extending between opposite sides of the periphery-engaging section, the contents-restraining portion including a barrier section, the barrier section covering only a portion of the cross-sectional area circumscribed by the periphery of the container, whereby the device when positioned on a container whose contents includes solid material, restrains the solid material within the container while allowing the liquid contents to pass therefrom.

1 Claim, 6 Drawing Figures

DRINKING CONTAINER DEVICE WITH ADJUSTABLE CLOSURE

This invention relates to a novel device for a drinking container and more particularly relates to a new device capable of being positioned adjacent the periphery of a drinking container.

Drinking containers such as glasses, cups and the like have been used throughout history. There have been very few changes in the design of such containers. Perhaps the greatest changes have been in the materials of which the containers are fabricated. For example, plastics have been used in the manufacture of many drinking vessels.

Most of the other modifications in the design of drinking containers have been for aesthetic considerations rather than utilitarian. Thus, most of the changes have been decorations on the container surface or have been appearance changes in the shape of the container. As a result, drinking containers presently in use differ only very slightly in their function or use as compared with historical containers.

One of the recent innovations in containers has been the covers utilized by many take-out eating facilities to seal the containers against spilling for the customers who take beverages away from the establishment where they have been purchased. Some of these covers have breakout openings for insertion of straws.

While such covers function effectively when an individual is drinking with a straw, they only are useful under that specific drinking situation. If a person does not wish to drink with a straw, the covers serve no useful function and must be removed. Since most people drink directly from a container without using a straw, these individuals are drinking from the same historical container designs in the same old way.

One type of drinking that is annoying for many people is drinking a beverage which includes some type of solid material. For example, many beverages include ice in some form, that is, ice cubes, crushed ice or the like. Other beverages include a solid material such as lemon or lime wedges or another ingredient that does not completely dissolve.

When a person drinks a beverage that has solid material therein, the solid material moves toward the edge of the container from which the person is drinking. The solid material has to be held back by the lips of the drinker. While some individuals, particularly children and teenagers, may enjoy the sensation of ice against their lips and mouths, many individuals do not appreciate it. Such persons have to improvise a way of avoiding contact of the ice or other solid material with their lips.

Some individuals sip their drinks slowly so that they can better control the movement of the ice toward their mouths. In this situation, the drinker has to be attentive to his beverage as he drinks it so that he does not accidentally tilt his glass too much and thus move the ice against his lips.

Other people order their beverages without ice to avoid the unpleasantness that occurs when ice contacts their lips. This solution to the problem ordinarily is not considered desirable by most people. If the beverage is not consumed quickly, it can become quite warm and unpalatable.

In view of the drawbacks of the above and other solutions to the difficulties encountered when drinking beverages with solid material, most individuals simply continue drinking in the conventional way and try to ignore the ice or other solid material as it moves into contact with their lips and mouths.

The present invention provides a novel device for a drinking container which overcomes the above problems encountered when drinking beverages with solid material. The device of the invention enables an individual to drink such a beverage without having ice or other solid material contact his lips or mouth. The device functions without attention from the drinker so that the drinker can handle his beverage container in the conventional manner.

The drinking container device of the present invention can be used conveniently by all types of individuals under many different conditions and situations. Children and the elderly as well as other persons with limited dexterity can use the device easily. The device can be installed on fine glassware and china without damage. The device can be used repetitively with simple washing or can be utilized as a single use item such as might be included with a beverage sold at a fast food counter.

The drinking container device of the invention is simple in design and can be manufactured relatively inexpensively. The device can be fabricated from commercially available materials using techniques presently employed by industry.

Other benefits and advantages of the novel drinking container device of the present invention will be apparent from the following description and the accompanying drawings in which.

Figure 1:
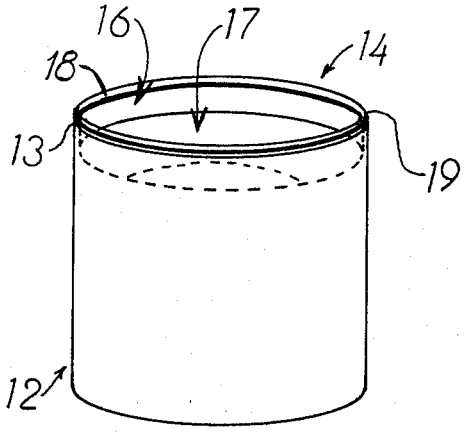
FIG. 1 is a view in perspective of one form of the device of the invention associated with a drinking container.
Figure 2:
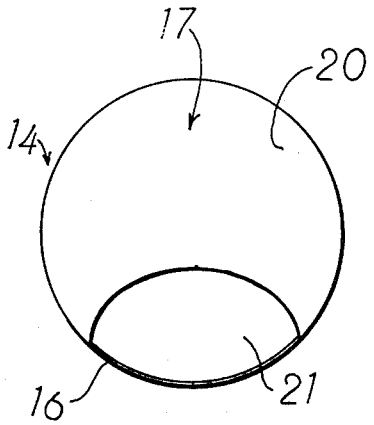
FIG. 2 is a top view of the drinking container device of the invention shown in FIG. 1.

As shown in FIGS. 1 and 2, a drinking container 12 having a peripheral rim 13 has one form of the novel device 14 of the present invention positioned thereon. The device is positioned adjacent the rim of the container.

The novel drinking container device 14 of the invention includes a positioning portion 16 and a contents-restraining portion 17. The positioning portion 16 includes a periphery-engaging section 18. Advantageously, the periphery-engaging section 18 is disposed at an angle to the contents-restraining portion 17 and preferably is substantially perpendicular thereto. The periphery-engaging section 18 includes resilient sidewall contacting means shown as peripheral lip section 19 that grips the rim of the container.

The contents-restraining portion 17 extends between opposite sides of the lower edge of the periphery-engaging section 18. The contents-restraining portion 17 includes a barrier section 20 which is recessed below the rim of container 12. The barrier section 20 covers only a portion of the cross-sectional area circumscribed by the periphery of the container.

Figure 3:
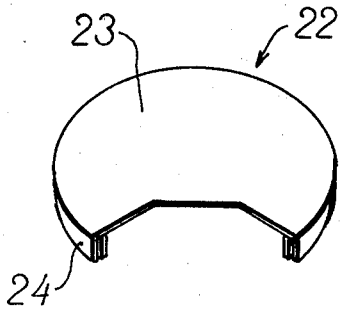
FIG. 3 is a view in perspective of another form of the drinking container device of the invention.

FIG. 3 illustrates another device of the invention. As shown, a device 22 has a barrier section 23 extending between opposite sides of a peripheral section 24. The device 22 is similar to that shown in FIGS. 1 and 2 with the exception that the peripheral section 24 is engageable with and extends down the outside of the rim of a container (not shown). Also, the barrier section 23 is disposed at the level of the rim of the container. Such a construction could be employed as a replacement for or a companion to a conventional cover currently being used by beverage counters or similar establishments.

Figure 4:
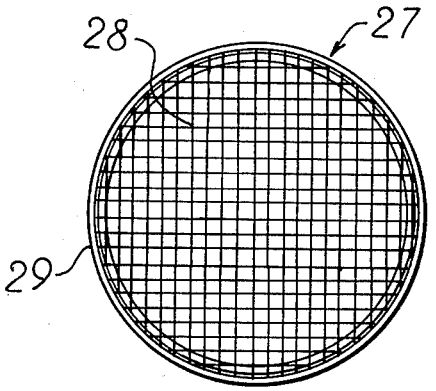
FIG. 4 is a top view of a further form of the drinking container device of the invention.

In FIG. 4 is shown a different device of the invention. The device 27 has a barrier section 28 and a periphery-engaging section 29. Barrier section 28 is a screen which is uniformly distributed over the cross-sectional area circumscribed by the periphery of the container. The device 27 is similar to that shown in FIGS. 1 and 2 in that the barrier section is recessed down into the container.

Figure 5:
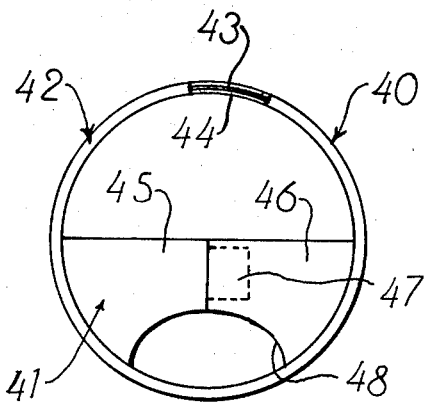
FIG. 5 is a top view partially in section of still another form of the drinking container device of the invention.

FIG. 5 illustrates a drinking container device which can be changed in size to accommodate different size containers. The device 40 includes a barrier section 41 and a periphery-engaging section 42. The periphery-engaging section 42 is expandable. This can be accomplished with an end portion 43 which is insertable into and slidable with respect to a cavity in an adjacent end portion 44. The periphery-engaging section 42 also is expandable and preferably includes a pair of barrier panels 45 and 46. The adjacent edges of the barrier panels 45 and 46 are slidably engageable with each other. This may be accomplished by utilizing overlapping edges or by having one edge 47 of barrier panel 45 insertable into a slot 48 of an adjacent barrier panel 46.

Figure 6:
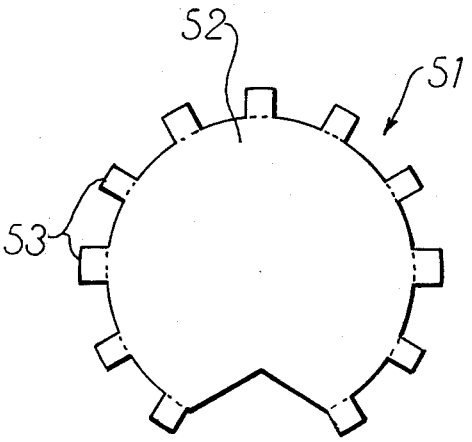
FIG. 6 is a top view of an additional form of the drinking container device of the invention.

FIG. 6 shows another form of drinking container device of the invention. The device 51 includes a solid barrier section 52 covering all but one portion of the cross-sectional area of the container opening. The device 51 also includes a periphery-engaging section shown as a plurality of spaced fingers 53. The device is positioned in a container by pushing the barrier section 52 down into the container so that the trailing fingers 53 extend outwardly and backwardly toward the edge of the container.

It will be seen from the above examples that the drinking container device of the present invention may have different configurations and shapes. Some of the designs fit into the opening of the container while others slip over the rim. Also, some of the designs utilize barrier sections which are solid panels with one or more openings therethrough. In addition, other barrier sections are partially open or grille-like panels that allow a liquid to pass therethrough. The partially open panels may cover all or only a portion of the cross-sectional opening of the container. Furthermore, the periphery-engaging section may be a continuous section or may be a plurality of spaced sections that are straight or may hook over the rim of a container.

The drinking container device of the invention may be fabricated from a variety of materials. For example, plastics, metals, wood, glass, combinations thereof and the like may be employed. The particular materials employed to a large extent will depend upon the specific use and container with which the devices are combined. In some uses, where the device is included with a purchased beverage, a simple, low cost, throwaway device may be most desirable. On the other hand, for home use, a hostess may wish a device which is recessed into the drinking container and may desire a device with a pleasing appearance in design and/or decoration. Also, the particular beverage and the solid material contained therein may determine the particular design selected.

In the use of the drinking container device shown in FIGS. 1 and 2, the device 14 is positioned with lip section 19 gripping the rim of the container 12. In this orientation, periphery-engaging section 18 is in contact with the upper inside surface of the container. Barrier section 20 is recessed slightly below the rim of the container and covers a substantial proportion of the cross-sectional area of the container. An individual drinking a beverage with ice or other solid material from the container 12 simply lifts the container 12 to his lips aligning the opening 21 on one side of barrier section 20 toward his mouth. Then, the container is tilted allowing liquid to pass into the person's mouth. The barrier section 20 restrains the ice from contacting the lips of the drinker so he can enjoy his drink without the unpleasantness of cold ice against his lips.

The device 22 shown in FIG. 3 is used in the same way as the device shown in FIGS. 1 and 2 with the exception that the device is attached to the container with peripheral section 24 engaging and extending down a portion of the outside surface of the container.

The devices shown in FIGS. 4 and 6 are positioned by sliding them inside the container in a manner similar to that described for the device of FIGS. 1 and 2. The device of FIG. 5 also is slid into the container but first the barrier section 41 and the peripheral section 42 are adjusted to a size which will provide a snug fit with the inside surface of the container.

The above description and the accompanying drawings show that the present invention provides a novel drinking container device which enables a person to drink beverages without having ice or some other solid material touching his lips. The device is simple to install on a container and convenient to use. An individual can drink his beverage in a normal manner without directing his attention to the device.

The drinking container device of the invention can be used with a wide variety of containers including fine glassware and china without damage. The device can be used over a period of years with simple washing between uses. In addition, the device of the invention can be fabricated as an inexpensive throwaway item, if desired. The device of the present invention is simple in design and can be fabricated from commercially available materials using conventional manufacturing techniques.

It will be apparent that various modifications can be made in the particular drinking container devices described in detail above and shown in the drawings within the scope of the invention. For example, the size and configuration of components can be changed to meet specific requirements. Also, the material employed in the fabrication of the device can be different for particular end uses. In addition, the contents-restraining portion can be modified for aesthetic considerations provided the function and operation of the device are not deleteriously affected. Therefore, the scope of the invention is to be limited only by the following claims.

What is claimed is:

1. A device for a drinking container including a positioning portion and a contents-restraining portion, said positioning portion including a periphery-engaging section, said periphery-engaging section including a resilient sidewall contacting member, said contents-restraining portion extending between opposite sides of said periphery-engaging section, said contents-restraining portion including a barrier section, said barrier section covering only a portion of the cross-sectional area circumscribed by the periphery of said container, said periphery-engaging section being expandable and including a cavity in one end thereof and a second end insertable into and slidable with respect to said cavity; said contents-restraining portion including a pair of adjacent barrier panels disposed in substantially the same plane, the adjoining edges of said barrier panels overlapping, a slot in an adjoining edge of a first of said barrier panels, and an adjoining edge of a second of said barrier panels insertable into and slidably engageable with said slot in said first barrier panel, whereby said device when positioned on a container whose contents includes solid material, restrains the solid material within said container while allowing the liquid contents to pass therefrom.

* * * * *